US010994531B2

(12) United States Patent
Anderson et al.

(10) Patent No.: US 10,994,531 B2
(45) Date of Patent: May 4, 2021

(54) DROP WEIGHTS CORRESPONDING TO DROP WEIGHT PATTERNS

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/490,823

(22) PCT Filed: Apr. 14, 2017

(86) PCT No.: PCT/US2017/027556
§ 371 (c)(1),
(2) Date: Sep. 3, 2019

(87) PCT Pub. No.: WO2018/190857
PCT Pub. Date: Oct. 18, 2018

(65) Prior Publication Data

US 2020/0047494 A1 Feb. 13, 2020

(51) Int. Cl.
*B41J 2/045* (2006.01)

(52) U.S. Cl.
CPC ..... *B41J 2/04543* (2013.01); *B41J 2/04568* (2013.01); *B41J 2/0458* (2013.01);
(Continued)

(58) Field of Classification Search
None
See application file for complete search history.

(56) References Cited

U.S. PATENT DOCUMENTS 6,046,822 A 4/2000 Wen et al.
6,239,829 B1 5/2001 Curry
(Continued)

FOREIGN PATENT DOCUMENTS

IN 202410 2/2007
JP 2003001820 1/2003
(Continued)

OTHER PUBLICATIONS

Boley, J.W. et al., Effect of Print Masks on the Functional Performance of Inkjet Printed PD Hexadecanethiolate in Toluene, Jul. 18, 2013 < http://www.jwilliamboley.com/pdf/pri.
(Continued)

*Primary Examiner* — Alejandro Valencia
(74) *Attorney, Agent, or Firm* — Trop Pruner & Hu PC

(57) ABSTRACT

In some examples, a fluidic die includes a plurality of fluid actuators to cause ejection of fluid towards a target, an actuation data register to store actuation data that indicates each fluid actuator of the plurality of fluid actuators to actuate, and a controller to use different drop weight patterns and actuation data in the actuation data register to dispense fluid of different drop weights using the plurality of fluid actuators. Each drop weight pattern of the different drop weight patterns indicates a respective set of fluid actuators of the plurality of fluid actuators enabled for actuation, and a first drop weight pattern of the different drop weight patterns corresponding to a first drop weight, and a second drop weight pattern of the different drop weight patterns corresponding to a second drop weight different from the first drop weight.

14 Claims, 7 Drawing Sheets

(52) U.S. Cl.
CPC ..... *B41J 2/04581* (2013.01); *B41J 2/04593* (2013.01); *B41J 2202/13* (2013.01)

(56) References Cited

U.S. PATENT DOCUMENTS

| | | | | |
|---|---|---|---|---|
| 6,241,334 | B1 * | 6/2001 | Haselby | B41J 2/2135 347/19 |
| 6,312,079 | B1 | 11/2001 | Anderson et al. | |
| 6,454,389 | B1 | 9/2002 | Couwenhoven et al. | |
| 6,478,396 | B1 * | 11/2002 | Schloeman | B41J 2/04543 347/12 |
| 6,705,691 | B2 | 3/2004 | Yamane et al. | |
| 6,932,453 | B2 | 8/2005 | Feinn et al. | |
| 8,016,389 | B2 | 9/2011 | Sheahan et al. | |
| 8,454,127 | B2 | 6/2013 | Nielsen et al. | |
| 8,651,632 | B2 | 2/2014 | Marcus et al. | |
| 9,061,521 | B2 | 6/2015 | Olson et al. | |
| 9,469,125 | B2 | 10/2016 | Humet et al. | |
| 9,475,286 | B2 | 10/2016 | Tuttnauer et al. | |
| 2003/0103105 | A1 | 6/2003 | Kawamura | |
| 2005/0190217 | A1 | 9/2005 | Wade et al. | |
| 2006/0268056 | A1 | 11/2006 | Molinet et al. | |
| 2014/0084843 | A1 | 3/2014 | Pham et al. | |
| 2016/0089885 | A1 | 3/2016 | Edelen et al. | |
| 2016/0303851 | A1 | 10/2016 | Sheperd | |
| 2017/0084882 | A1 * | 3/2017 | Vronsky | H01L 21/02288 |

FOREIGN PATENT DOCUMENTS

| | | |
|---|---|---|
| WO | WO-2013115804 | 8/2013 |
| WO | WO-2014084843 | 6/2014 |
| WO | WO-2018190855 | 10/2018 |
| WO | WO-2018190858 | 10/2018 |

OTHER PUBLICATIONS

HP High Definition Nozzle Architecture < http://www8.hp.com/h20195/v2/GetPDF.aspx/4AA6-1075ENW.pdf >.

* cited by examiner

DROP WEIGHTS CORRESPONDING TO DROP WEIGHT PATTERNS

BACKGROUND

Fluid control devices such as fluidic dies can control movement and ejection of fluid. Such fluidic dies may include fluid actuators that may be actuated to cause displacement of fluid. Some example fluidic dies may include printheads, where fluids used by the printheads can include ink or other types of fluids.

BRIEF DESCRIPTION OF THE DRAWINGS

Some implementations of the present disclosure are described with respect to the following figures.

Figure 1:
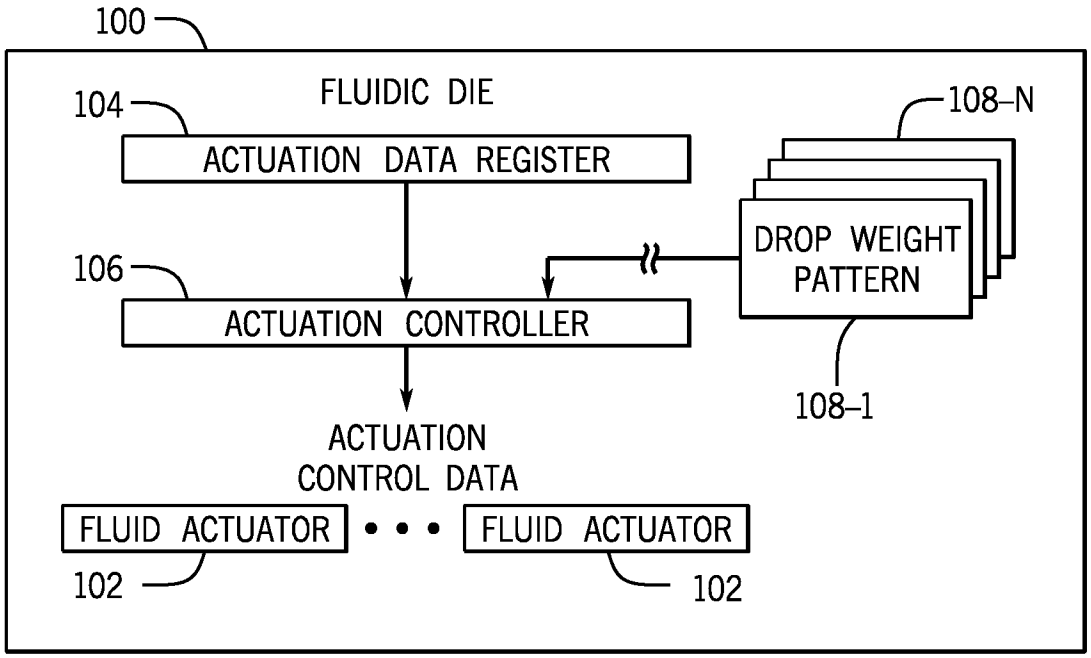
FIG. 1 is a block diagram of a fluidic die according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid ejection device can be used to dispense fluid through orifices of nozzles to a target. In some examples, fluid ejection devices can include printheads that are used in two-dimensional (2D) or three-dimensional (3D) printing. In 2D printing, a printhead can eject ink or other printing fluid directed to a target substrate (e.g., paper, plastic, etc.) to print a pattern onto the target substrate. In 3D printing, a printhead can eject a fluid used to form a 3D target object. A 3D printing system can form the 3D target object by depositing successive layers of build material. Printing fluids dispensed from the 3D printing system can include ink, as well as fluids used to fuse powders of a layer of build material, detail a layer of build material (such as by defining edges or shapes of the layer of build material), and so forth.

More generally, a fluid ejection device can be used in either a printing application or a non-printing application. Examples of fluid ejection devices used in non-printing applications include fluid ejection devices in fluid sensing systems, medical systems, vehicles, fluid flow control systems, and so forth. In a printing application, a fluid ejection device, such as a fluidic die, can be mounted onto a print cartridge, where the print cartridge can be removably mounted in a print system. For example, the fluidic die can be a printhead die that is mounted to the print cartridge. In another example of a printing application, fluid ejection devices (such as fluidic dies) can be mounted onto a print bar that spans the width of a target medium (e.g., a paper medium or medium of another material) onto which printing fluids are to be dispensed.

A drop weight of a fluid can refer to an amount of the fluid that is ejected by a nozzle in response to a single actuation event. In some cases, a drop weight can also be referred to as a drop size. A drop weight is proportional to a drop volume of a fluid. Fluid ejection systems can include fixed drop-weight nozzles, where each nozzle is able to eject just fluids of one drop weight. Being restricted to a fixed drop weight can reduce flexibility and quality of patterns formed on a target by a fluid dispensed by a fluid ejection system. In other examples, a fluid ejection system includes dedicated nozzles for achieving an increased drop weight. However, use of dedicated nozzles for achieving an increased drop weight can reduce a density of dispensed fluid (such as expressed in dots per inch).

In accordance with some implementations of the present disclosure, as shown in FIG. 1, a fluidic die 100 includes a multiple fluid actuators 102 to cause ejection of fluid towards a target. A fluidic die can refer to a structure that includes a substrate on which are provided various layers (e.g., thin film layers) to form fluid channels, orifices, fluid actuators, fluid chambers, electrical conductors, and so forth. Some example substrates of fluidic dies can include silicon based substrates, glass based substrates, gallium arsenide based substrates, and/or other such suitable types of substrates for micro fabricated devices and structures.

In some examples, a fluid actuator 102 can be disposed in a nozzle of the fluidic die 100, where the nozzle may include a fluid chamber and a nozzle orifice in addition to the fluid actuator. The fluid actuator 102 may be actuated such that displacement of fluid in the fluid chamber may cause ejection of a fluid drop through the nozzle orifice. Accordingly, a fluid actuator disposed in a nozzle may be referred to as a fluid ejector.

The fluid actuators 102 can be arranged as an array of fluid actuators, which can be a 1-dimensional (1D) array of fluid actuators or a two-dimensional (2D) array of fluid actuators. In other examples, the fluid actuators 102 can be arranged in a different pattern.

A fluid actuator 102 can include an actuator that includes a piezoelectric membrane, an actuator that includes a thermal resistor, an actuator that includes an electrostatic membrane, an actuator that includes a mechanical/impact driven membrane, an actuator that includes a magneto-strictive drive actuator, or other such elements that may cause displacement of fluid responsive to electrical actuation or actuation resulting from another type of input stimulus.

Although FIG. 1 depicts various components of a fluidic die, it is noted that in other examples, similar components can be arranged in other types of fluid control devices.

As further shown in FIG. 1, the fluidic die 100 includes an actuation data register 104. A "register" can refer to any storage element that can be used to store data. For example, a register can be part of a portion of a memory device, such as a dynamic random access memory (DRAM), a static random access memory (SRAM), a flash memory, or any other type of memory device. Alternatively, a register can refer to a storage buffer, a data latch, or any other data holding device that can temporarily or persistently store data.

The actuation data register 104 can store actuation data that indicates each fluid actuator to actuate for a set of actuation events. Actuating a fluid actuator refers to causing operation of the fluid actuator to perform fluid displacement in the fluidic die 100. An actuation event can refer to concurrent actuation of fluid actuators of the fluidic die 100 to cause fluid displacement. An actuation event can be responsive to a command issued to the fluidic die, or a command issued in the fluidic die, to cause fluid displacement to occur. A "set of actuation events" can refer to any sequence or collection of events that can cause respective different groups of fluid actuators 102 to actuate.

Assuming there are M (M≥1) fluid actuators 102, the actuation data stored in the actuation data register 104 includes M values that correspond to the M fluid actuators 102. In some examples, each value of the M values can be provided by a single bit, where a first state (e.g., "1") of the bit indicates that the corresponding fluid actuator 102 is to be actuated, and a different second state (e.g., "0") of the bit indicates that the corresponding fluid actuator 102 is to remain un-actuated. In other examples, each value of the M values in the actuation data can be represented using multiple bits, where a first value of the multiple bits indicates that a corresponding fluid actuator 102 is to be actuated, and a different second value of the multiple bits indicates that the corresponding fluid actuator 102 is to remain un-actuated.

The fluidic die 100 further includes an actuation controller 106 that receives as input the output of the actuation data register 104, and multiple drop weight patterns 108-1 to 108-N(N≥2). Each drop weight pattern of the different drop weight patterns 108-1 to 108-N indicates a respective set of fluid actuators of the multiple fluid actuators enabled for actuation in response to an actuation event. Enabling a fluid actuator for actuation can refer to allowing the fluid actuator to be activated in response to a value of the actuation data in the actuation data register 104 specifying that the fluid actuator is to be actuated.

In other words, if a value of a drop weight pattern indicates that a particular fluid actuator is not enabled for actuation, then the particular fluid actuator will not be actuated even though the actuation data stored in the actuation data register 104 specifies that the particular fluid actuator 102 should be actuated. On the other hand, if a drop weight pattern specifies that the particular fluid actuator is enabled for actuation, the particular fluid actuator is actuated only if the actuation data stored in the actuation data register 104 specifies that the particular fluid actuator is to be actuated. More specifically, a given fluid actuator 102 is to be actuated in response to both a value of the actuation data register 104 specifying that the given fluid actuator 102 is to be actuated, and a corresponding value of the drop weight pattern enabling actuation of the given fluid actuator 102.

A first drop weight pattern of the different drop weight patterns 108-1 to 108-N corresponds to a first drop weight, and a second drop weight pattern of the different drop weight patterns 108-1 to 108-N corresponds to a second drop weight different from the first drop weight. For example, the first drop weight pattern can indicate that a first number of fluid actuators (within a primitive) are to be actuated to achieve the first drop weight, while the second drop weight pattern indicates that a different second number fluid actuators (within a primitive) are to be actuated to achieve the second drop weight. The concept of a "primitive" is discussed further below.

The drop weight patterns 108-1 to 108-N can be stored in respective storage locations, which can be within a same storage device or different storage devices. For example, the drop weight patterns 108-1 to 108-N can be stored in respective different mask registers. A drop weight pattern can have M values that correspond to M fluid actuators 102. Each value of the M values in the drop weight pattern can be provided by a single bit or can be provided by multiple bits.

The actuation controller 106 can selectively use different ones of the drop weight patterns to combine with the actuation data in the actuation data register 104 to dispense fluid of different drop weights using the fluid actuators 102. A "controller" as used herein can refer to any hardware processing circuit, which can include logic circuitry, a microprocessor, a core of a multi-core microprocessor, a microcontroller, a programmable gate array, a programmable integrated circuit device, or any other hardware processing circuit. In further examples, a controller can include a combination of a hardware processing circuit and machine-readable instructions executable on the hardware processing circuit.

Although not shown in FIG. 1, selection of one of the drop weight patterns can be achieved by using a selection logic, such as a multiplexer (discussed further below). The selected drop weight pattern is provided by the selection logic to the actuation controller 106.

In response to the actuation data in the actuation data register 104 and a selected drop weight pattern, the actuation controller 106 can output actuation control data to control which of the fluid actuators 102 are actuated. By being able to selectively use different drop weight patterns to control actuation of the fluid actuators 102, different drop weights can be achieved on the fly while a fluid displacement operation (e.g., a printing operation) is ongoing. This provides flexible control to achieve target goals when performing the fluid displacement operation. For example, in 2D print systems, nozzles that produce fluid droplets of a smaller drop weight can be useful for forming regions of an image where improving image grain (and thus image quality) is a priority, such as in photographs. In contrast, nozzles that produce fluid droplets of a larger drop weight can more efficiently be used to perform higher density area fills (such as to fill a relatively large region of the same color), since a larger amount of ink can be dispensed with a lower amount of data bandwidth in the print system. Dispensing fluid droplets of a larger drop weight can also have a smaller thermal impact on a fluidic die than dispensing fluid droplets of a smaller drop weight.

Figure 2:
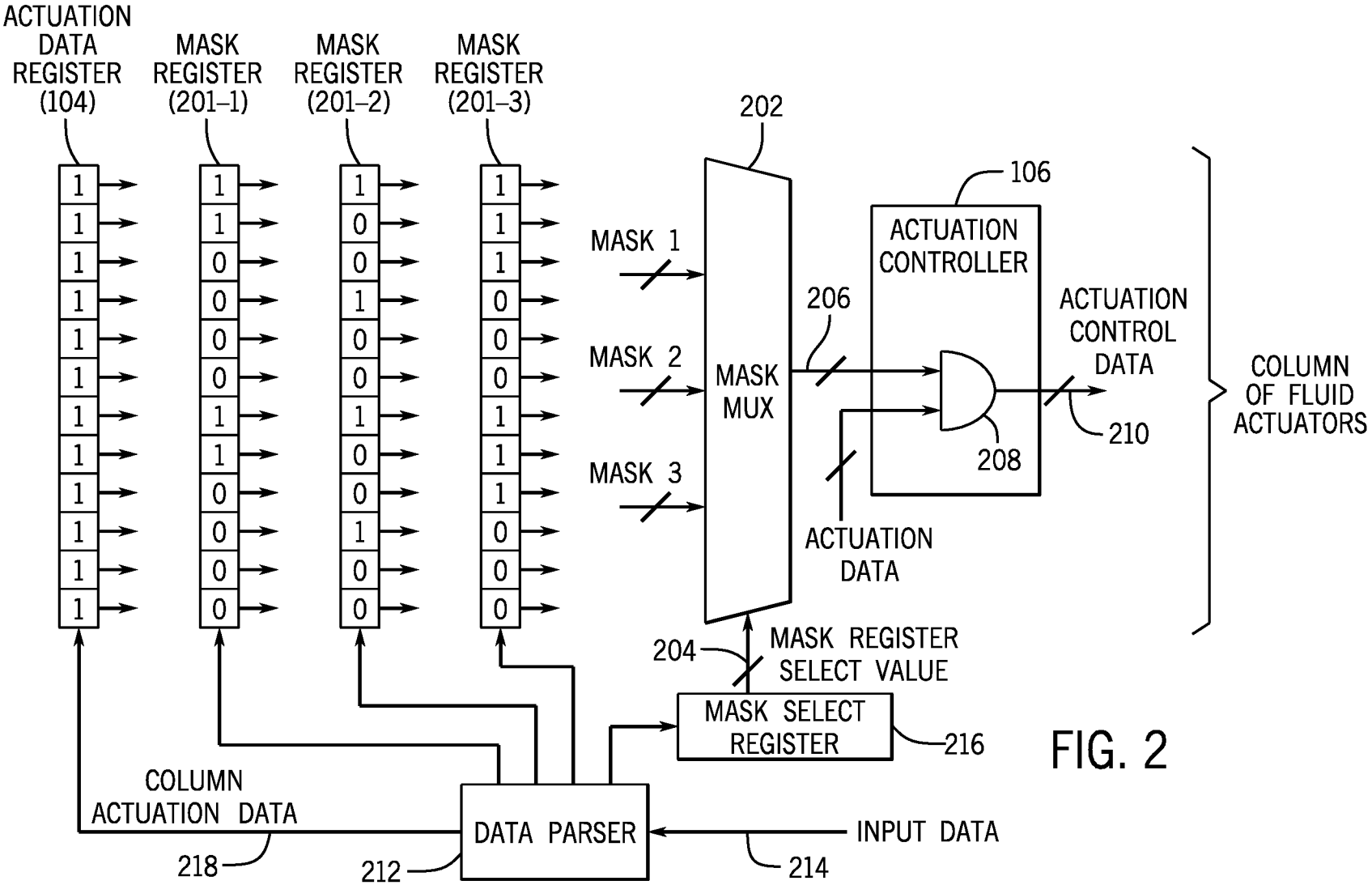
FIG. 2 is a block diagram of a fluidic die according to further examples.

FIG. 2 shows an example arrangement of a fluidic die that includes the actuation data register 104 and three mask registers 201-1, 201-2, and 201-3. Although a specific number of mask registers are shown, it is noted that in different examples, different numbers of mask registers can be used. The logic shown in FIG. 2 controls actuation of a column of fluid actuators. Similar logic can be repeated for other columns of fluid actuators.

In some examples, an array of the fluid actuators 102 can be arranged as rows and columns. In the example shown in FIG. 2, it is assumed that a column includes 12 actuators, such that each of the actuation data register 104 and mask registers 201-1 to 201-3 stores 12 bits of data. In a different example, a column of fluid actuators can include a different number of fluid actuators. The example actuation data stored in the actuation data register 104 is all "1" s, to specify that all of the fluid actuators in the column are to be actuated. In other examples, a different actuation data can be stored in the actuation data register 104.

The mask registers 201-1, 201-2, and 201-3 store respective different drop weight patterns, where each drop weight pattern includes 12 bits to correspond to the 12 fluid actuators in the column.

In examples shown in FIG. 2, it is assumed that a "1" value indicates an active state, while a "0" value indicates an inactive state. Thus, a "1" value in the actuation data register indicates that a respective fluid actuator is to be actuated, while a "0" value in the actuation data register 104 indicates that the respective fluid actuator is not to be actuated. A "1" value in a mask register indicates that a respective fluid actuator is enabled for actuation, while a "0" value in the mask register indicates that the respective fluid actuator is not enabled for actuation.

A mask multiplexer 202 selects a drop weight pattern from among the three drop weight patterns stored in the respective mask registers 201-1, 201-2, and 201-3. A "multiplexer" can refer to any logic that is able to select from among multiple inputs, where the selected input is provided to the output of the multiplexer. In FIG. 2, the three different drop weight patterns are represented as Mask 1 (from the mask register 201-1), Mask 2 (from the mask register 201-2), and Mask 3 (from the mask register 201-3), which are provided to three sets of inputs of the mask multiplexer 202. A mask select value 204 is provided to the select control input of the mask multiplexer 202, to select one of the drop weight patterns to propagate to the output 206 of the mask multiplexer 202. Note that each of the inputs of the mask multiplexer 202 and the output 206 of the mask multiplexer 202 is 12 bits in width.

The mask select value 204 is a value stored in a mask select register 216 (discussed further below).

The output 206 of the mask multiplexer 202 is provided to an input of the actuation controller 106. The actuation data from the actuation data register 104 is also provided to an input of the actuation controller 106. In the example of FIG. 2, the output 206 of the mask multiplexer 202 and the actuation data are each 12 bits in width. The actuation controller 106 includes an AND function 208, which receives as input the mask multiplexer output 206 (containing the selected drop weight pattern, as selected from among Mask 1, Mask 2, and Mask 3) and the actuation data from the actuation data register 104, and produces as output an actuation control data 210 (also 12 bits in width). Each bit of the actuation control data 210 is a logical AND of a respective bit of the selected drop weight pattern, and the corresponding bit of the actuation data. A bit of the actuation control data 210 is active in response to both the corresponding bit of the selected drop weight pattern and the corresponding bit of the actuation data being active. Although an AND function 208 is depicted, it is noted that in other examples, other logic for producing the actuation control data 210 based on the actuation data and the selected drop weight pattern can be used. The concept is that an actuation control bit (or other value) of the actuation control data 210 for actuating a respective fluid actuator is set to an active value in response to both the corresponding actuation data bit (or other value) in the actuation data and the drop weight bit (or other value) in the selected drop weight pattern being set to an active value.

The actuation controller 106 can include other logic not shown, in addition to the AND function 208. For example, the actuation controller 106 can include a register to store the actuation control data 210. The actuation control data 210 is provided to the column of fluid actuators (or activation circuits of the fluid actuators) to actuate selected fluid actuators in the column. The fluid actuators not selected (because either the corresponding bit in the actuation data or the corresponding bit in the selected drop weight pattern is inactive) remain inactive (i.e., not actuated).

The mask select value 204 causes the mask multiplexer 202 to select a first mask register for a first set of actuation events, and select a second mask register for a second set of actuation events. For the first set of actuation events, the actuation controller 106 controls actuation of the fluid actuators 102 based on actuation data in the actuation data register 104 and the drop weight pattern in the first mask register. For the second set of actuation events, the actuation controller 207 controls actuation of the fluid actuators 102 based on actuation data in the actuation data register 104 and the drop weight pattern in the second mask register.

FIG. 2 further shows a data parser 212 that receives input data 214. The input data 214 can be provided by a fluid ejection system to the fluidic die shown in FIG. 2. In different phases of operation, the data parser 212 causes loading of the actuation data register 104 and selected mask register(s). The data parser 212 is a form of data loading logic to control loading of data into respective registers. The data parser 212 writes column actuation data 218 into the actuation data register 104 during a fluid displacement phase, during which the fluidic die causes displacement of fluid (e.g., eject fluid during a printing operation). The data parser 212 writes a drop weight pattern into a selected mask register (201-1, 201-2, or 201-3) during a mask register write phase, which can be part of initialization of the fluidic die, as well as in subsequent phases when updating of the drop weight pattern in a mask register is to be performed.

The data parser 212 can also write a mask select value into the mask select register 216, where the mask select value is to select from among the drop weight patterns Mask 1, Mask 2, and Mask 3 for output by the mask multiplexer 202. Details of the operation of the data parser 212 are explained further below.

In some examples, different drop weight patterns 108-1 to 108-N can indicate different primitive sizes. Thus, in the example of FIG. 2, the drop weight pattern (Mask 1) stored in the mask register 201-1 indicates a first primitive size, the drop weight pattern (Mask 2) stored in the mask register 201-2 indicates a second primitive size, and the drop weight pattern (Mask 3) stored in the mask register 201-3 indicates a third primitive size, where the first, second, and third primitive sizes are different from each other. Note that in other cases, different drop weight patterns can indicate the same primitive size. Generally, different drop weight patterns can indicate different drop weights, whether for the same primitive size or for different primitive sizes.

The multiple fluid actuators 102 of a fluidic die can be partitioned into "primitives," where a primitive (or equivalently a "firing primitive") includes a group of a certain number of fluid actuators. Each fluid actuator of a primitive can be uniquely addressed to select the fluid actuator.

In some examples, electrical and fluidic constraints of a fluidic control device may restrict a number of fluid actuators that can be actuated concurrently for a given actuation event. For example, to reduce a peak electrical current in the fluid control device, only one fluid actuator (or a smaller number of fluid actuators) is (are) activated in each primitive for the given actuation event.

A number of fluid actuators included in a primitive can be referred to as a size of the primitive. Traditionally, primitives of a fluid control device are configured using hardware circuitry, and thus a size of the primitives used in the fluid control device is fixed. Using a fixed-size primitive reduces flexibility in the control of fluid displacement. For example, it may be difficult using fixed-size primitives to switch between different modes of fluid displacement (e.g., different printing modes of a printing system such as to provide different drop weights), particularly when switching between the different modes of fluid displacement is to occur on the fly during a fluid displacement operation (e.g., during a printing operation).

In accordance with some implementations of the present disclosure, variable-sized primitives (also referred to as "virtual primitives") can be used in a fluidic die. For a first actuation event (or a first set of actuation events), primitives of a first primitive size can be used, while for a second actuation event (or second set of actuation events), primitives of a second primitive size (different from the first primitive size) can be used. Varying sizes of primitives can be implemented by using different drop weight patterns. To improve throughput of the fluidic die when switching between different drop weight patterns, the different drop weight patterns can be stored in respective mask registers (e.g., 201-1 to 201-3 in FIG. 2). The multiplexer 202 can select from among the mask registers 201-1 to 201-3 to select the drop weight pattern to use for each given actuation event (or each given set of actuation events), to achieve different primitive sizes and/or different drop weights.

Figure 3B:
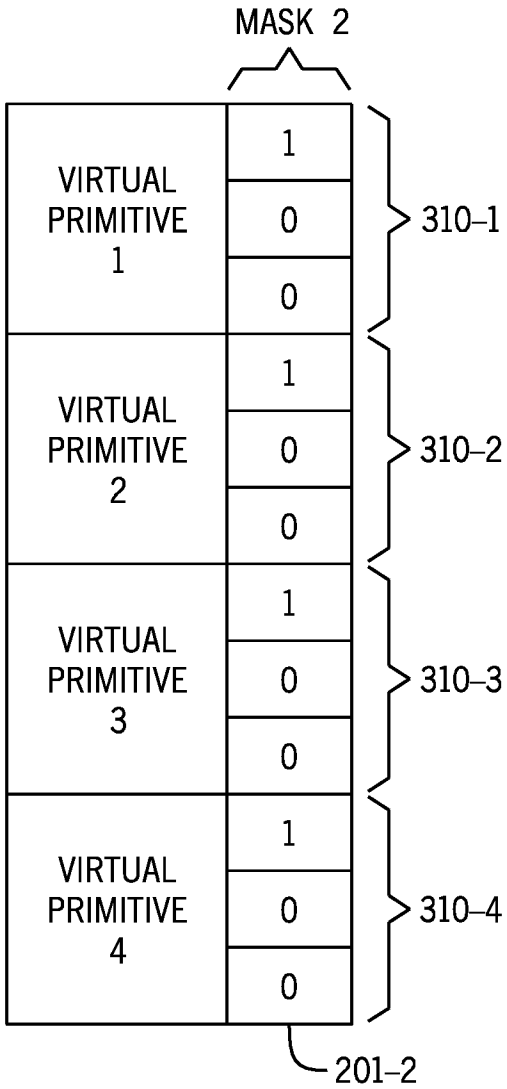
FIGS. 3A and 3B illustrate virtual primitives corresponding to respective different drop weight patterns.
Figure 3A:
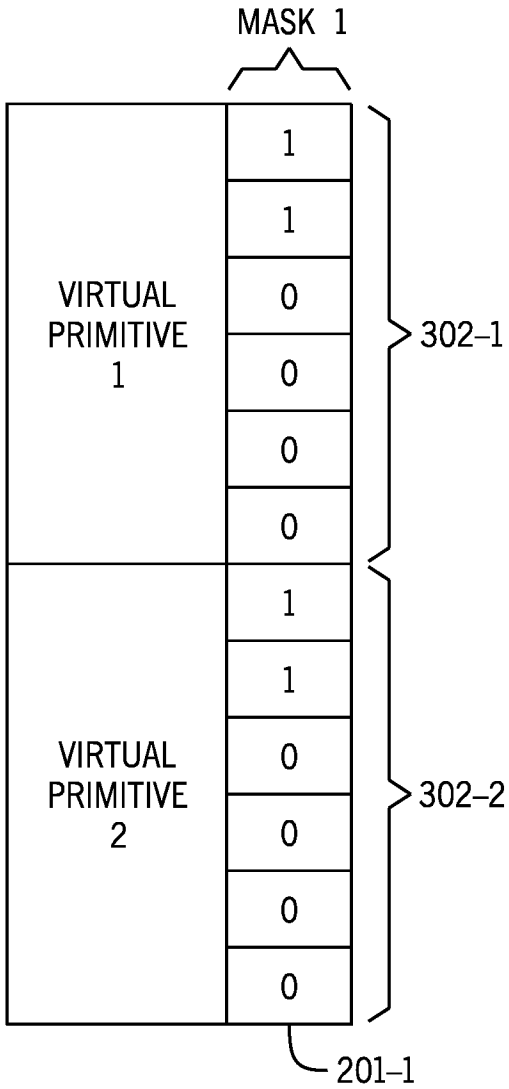

FIG. 3A shows an example of virtual primitives corresponding to the first primitive size specified by drop weight pattern Mask 1, which is stored in the mask register 201-1. As used here, a "virtual primitive" can refer to a primitive with a size that can be dynamically changed by using different drop weight patterns. The drop weight pattern Mask 1 indicates a primitive size of 6 (i.e., each primitive includes six fluid actuators). Since each primitive includes six fluid actuators, the 12 fluid actuators of a column are divided into two virtual primitives. FIG. 3A shows two virtual primitives 1 and 2.

The drop weight pattern Mask 1 is divided into two groups 302-1 and 302-2 of drop weight pattern bits. Each group 302-1 or 302-2 contains six drop weight pattern bits, where each drop weight pattern bit effectively addresses a respective fluid actuator. Thus, if a bit in a drop weight pattern group is set to "1" (or other active state or active value), then the corresponding fluid actuator is addressed (enabled) for actuation. On the other hand, if a bit in a drop weight pattern group is set to "0" (or other inactive state or inactive value), then the corresponding fluid actuator is not addressed for actuation (i.e., the corresponding fluid actuator is disabled).

More generally, each drop weight pattern includes multiple occurrences of a sequence of bits set to respective values (a first occurrence of the sequence of bits set to respective values is group 302-1 in FIG. 3A, and a second occurrence of the sequence of bits set to respective values is group 302-2 in FIG. 3A).

In the example of FIG. 3A, within each drop weight pattern group 302-1 or 302-2, two bits are set to the active state "1" while the remaining bits are set to the inactive state "0." Thus, each drop weight pattern group 302-1 or 302-2 specifies a drop weight of two, since two fluid actuators in each virtual primitive are enabled for actuation in response to a single actuation event.

As shown in FIG. 3B, the drop weight pattern Mask 2 stored in the mask register 201-2 indicates a primitive size of three. In FIG. 3B, four virtual primitives 1, 2, 3, and 4, each of size three are depicted. Each virtual primitive 1, 2, 3, or 4 is associated with a respective group 310-1, 310-2, 310-3, or 310-4 of drop weight pattern bits. In some examples, within each drop weight pattern group 310-1, 310-2, 310-3, or 310-4, just one bit is set to the active state "1" while the remaining bits are set to the inactive state "0." Thus, each drop weight pattern group 310-1, 310-2, 310-3, or 310-4 specifies a drop weight of one.

Note that different drop weights do not have to be associated with different primitive sizes, as different drop weight patterns that specify different drop weights can indicate use of the same primitive size.

The drop weight pattern Mask 3 (stored in the mask register 201-3 of FIG. 2) also indicates a primitive size of six. However, the drop weight specified by the drop weight pattern Mask 3 is three, since three bits are set to "1" for each primitive indicated by the drop weight pattern Mask 3.

Effectively, the drop weight patterns specify the virtual address structure to be used in a given column of fluid actuators. Each drop weight pattern defines a number of virtual addresses, and how many fluid actuators to fire within a virtual primitive at a time.

Figure 4:
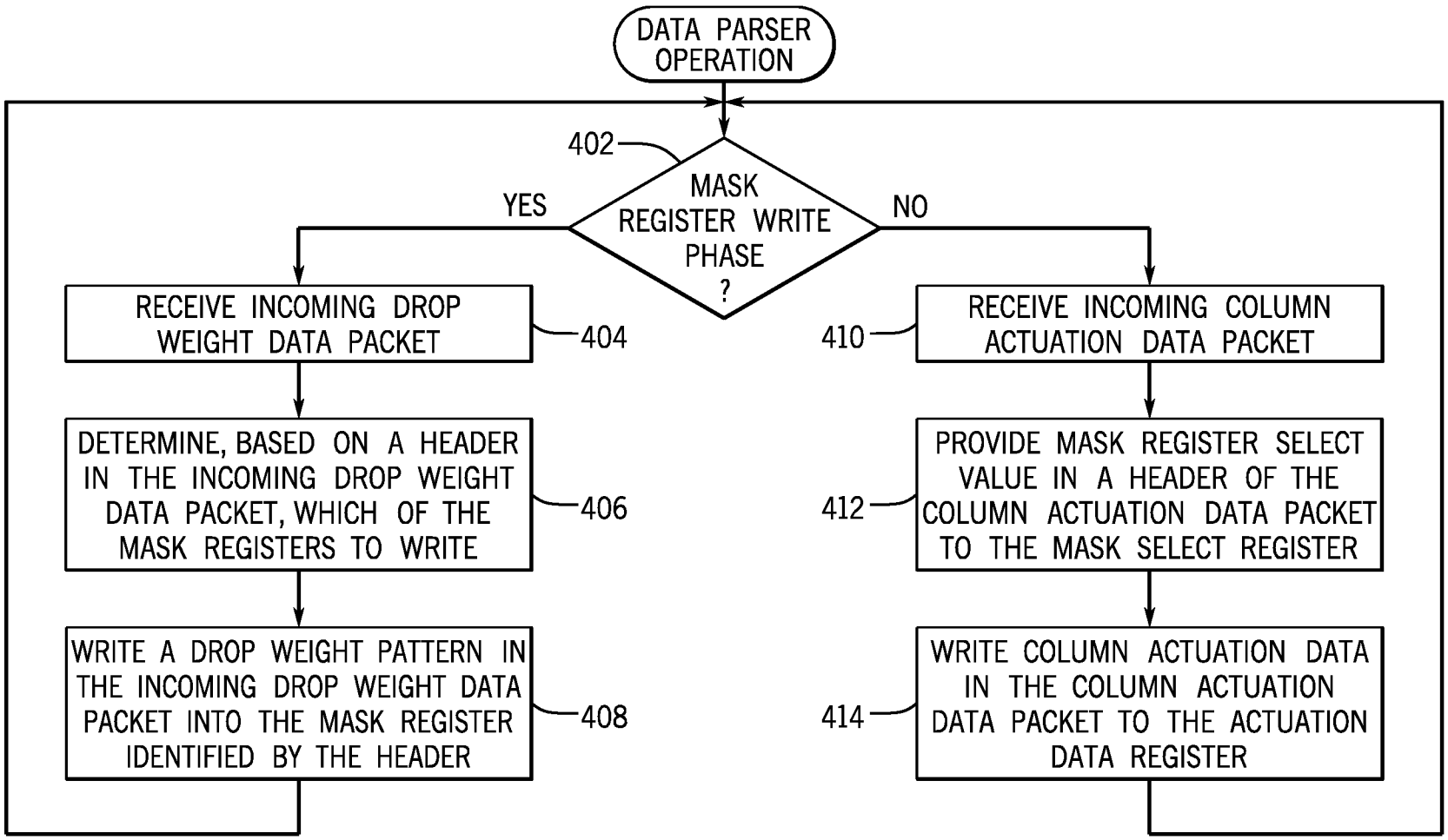
FIG. 4 is a flow diagram of a process of a data parser according to some examples.

FIG. 4 is a flow diagram of an example operation of the data parser 212 of FIG. 2, according to some implementations of the present disclosure. The data parser 212 can be operated in one of two phases: a mask register write phase or a fluid displacement phase. During the mask register write phase, a drop weight pattern is loaded into a mask register (or multiple drop weight patterns are loaded into respective mask registers). In the fluid displacement phase, column actuation data is loaded into the actuation data register, and one of the mask registers is selected to use for enabling actuation of fluid actuators.

As shown in FIG. 4, the data parser 212 determines (at 402) whether the data parser 212 is in the mask register write phase or in the fluid displacement phase. This determination can be based on an indication provided by a fluid control system (e.g., a controller of a printing system) to the data parser 212. A first indication can indicate to the data parser 212 that the data parser 212 is to operate in the mask register write phase, while a second indication indicates that the data parser 212 is to operate in the fluid displacement phase. The first or second indication can be provided as a respective command, message, information field (such as in a header or payload of a data packet), and so forth.

In response to determining that the data parser 212 is to operate in the mask register write phase, the data parser 212 receives (at 404) an incoming drop weight data packet. As used here, a "data packet" can refer to any collection of data values, whether contained as a single unit of data or as multiple units of data. The data packet can include a header and a payload, where the payload carries the drop weight pattern, and the header contains control information.

The parser 212 determines (at 406), based on the header in the incoming drop weight data packet, which of the mask registers 106-1, 106-2, or 106-3 to write. The header of the incoming drop weight data packet can include an information field that is settable to one of multiple different values that correspond to selection of different ones of the mask registers 106-1, 106-2, and 106-3.

The data parser 212 then writes (at 408) a drop weight pattern in the payload of the incoming drop weight data packet into the mask register identified by the header of the incoming drop weight data packet.

The process then returns to task 402. In the next iteration, another mask register write phase can be performed to write to another mask register.

If the data parser 212 determines (at 402) that the data parser 212 is not in the mask register write phase (i.e., the data parser 212 is in the fluid displacement phase), the data parser 212 receives (at 410) an incoming column actuation data packet. The incoming column actuation data packet includes a header and a payload, where the payload contains the column actuation data.

In some cases, the header of the column actuation data packet can include a mask register select value. Note that not all incoming column actuation data packets would include a mask register select value. In other examples, each incoming column actuation data packet would include a header with a mask register select value, where the mask register select value is for loading into the mask select register 216 (FIG. 2) and is used in selecting one of the drop weight patterns in the mask registers 201-1, 201-2, and 201-3.

The data parser 212 provides (at 412) the mask register select value in the header of the column actuation data packet to the mask select register 216. The mask select register 216 stores the mask register select value, which is provided to the control input of the mask multiplexer 202 shown in FIG. 2 to select one of the multiple inputs to the mask multiplexer 202. Updating the mask register select value in the mask select register 216 causes selection of a different drop weight pattern.

The data parser 212 further writes (at 414) the column actuation data in the payload of the column actuation data packet to the actuation data register 104.

The process then returns to task 402.

Figure 5:
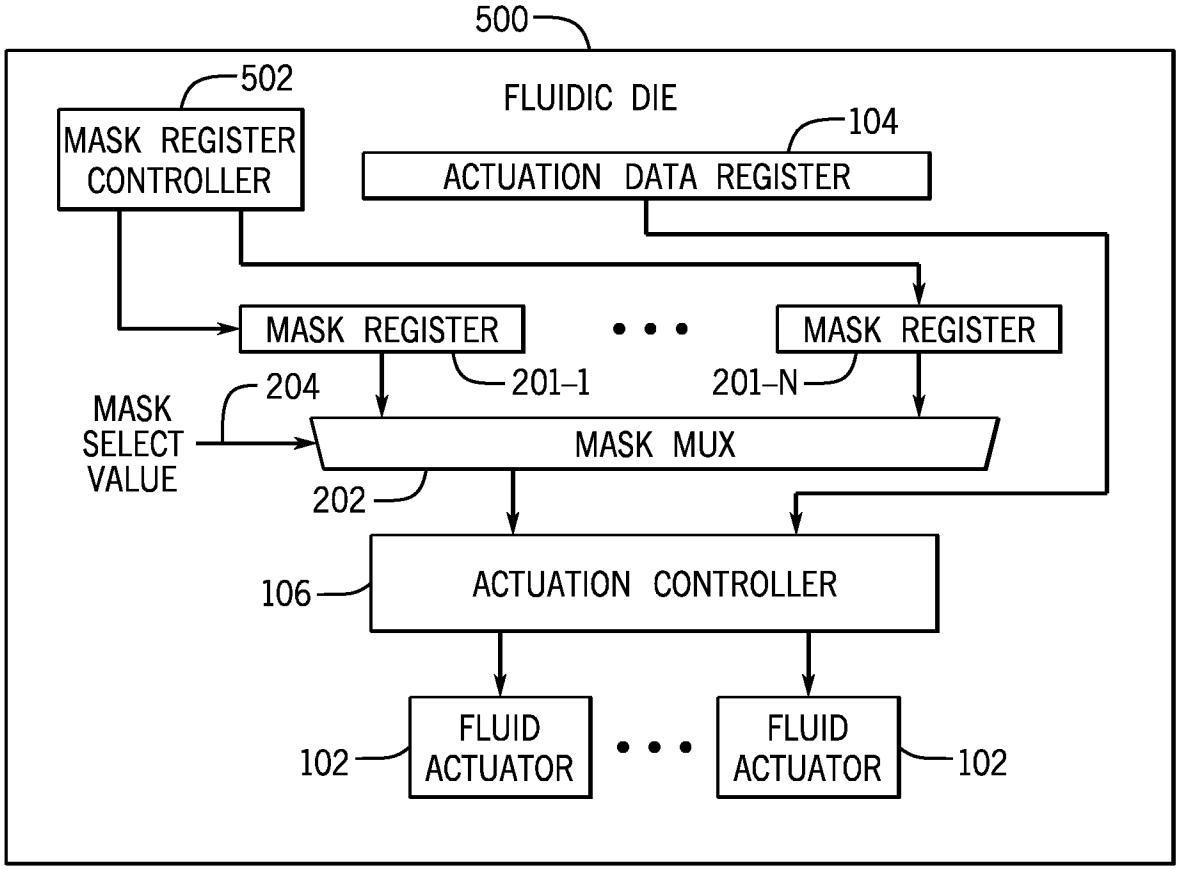
FIG. 5 is a block diagram of a fluidic die according to further examples.

FIG. 5 is a block diagram of a fluidic die 500 according to further examples. The fluidic die 500 includes various components that are similar to those of FIG. 1 and/or FIG. 2, including the actuation data register 104, the mask registers 201-1 to 201-N, the mask multiplexer 202, the actuation controller 106, and the fluid actuators 102.

The fluidic die 500 further includes a mask register controller 502, which controls a shifting operation of a selected mask register of the mask registers 201-1 to 201-N. As noted above, in some examples, within a given virtual primitive, just a subset of the fluid actuators (where a subset can include one fluid actuator or multiple fluid actuators) of the virtual primitive is actuated in response to a respective actuation event. To actuate all of the fluid actuators of the virtual primitive, a set of actuation events are provided, where each successive actuation event of the set corresponds to actuation of a next subset of fluid actuators of the virtual primitive.

Figure 6B:
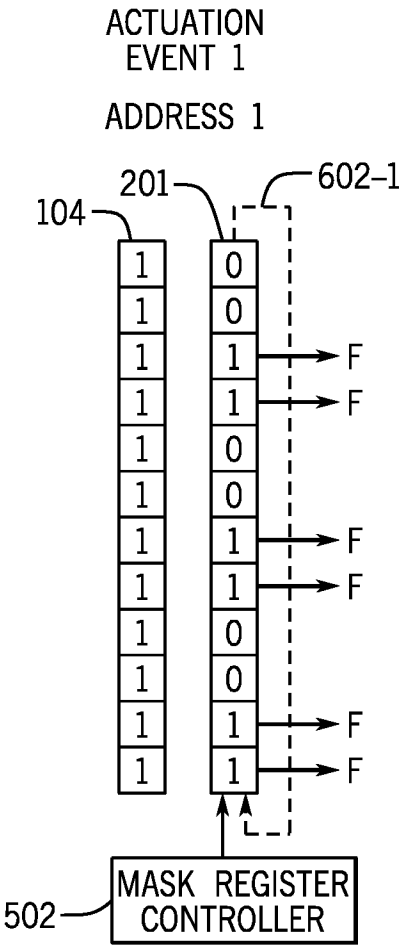
FIGS. 6A-6B illustrate shifting of a drop weight pattern in a mask register, according to additional examples.
Figure 6A:
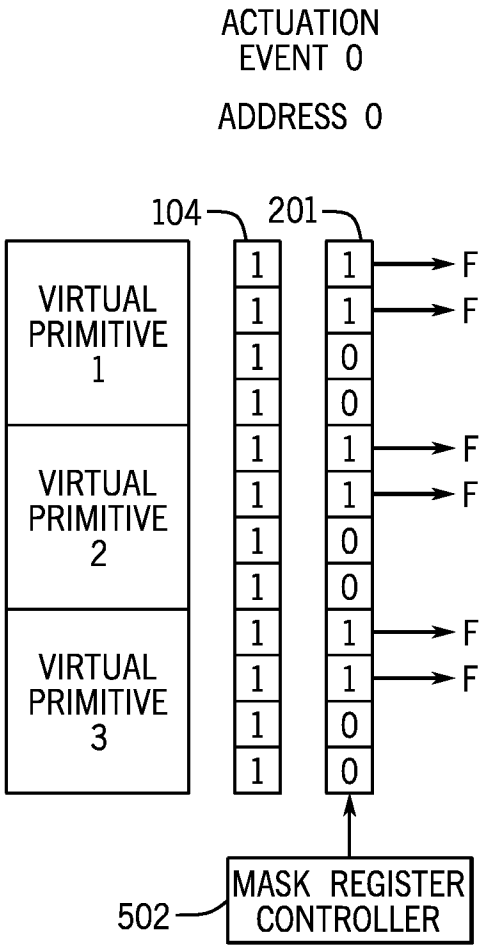

FIGS. 6A-6B show an example where a selected drop weight pattern (in a mask register 201) indicates a primitive size of four, i.e., each virtual primitive has four fluid actuators. Also, the drop weight pattern sets a drop weight of two, since two bits are set to "1" for each virtual primitive, and the remaining two bits are set to "0" in the virtual primitive. Assuming a column of 12 fluid actuators, the column is divided into three virtual primitives 1, 2, and 3 (as shown in FIG. 6A). A set of two actuation events (actuation event 0 and actuation event 1) is provided to cause actuation of the four fluid actuators in each virtual primitive at two successive times.

FIG. 6A shows actuation event 0, in which addresses 0 and 1 are selected by the drop weight pattern in the mask register 201. The fluid actuators in the three virtual primitives assigned addresses 0 and 1 are enabled for actuation. The actuation data register 104 contains all "1"s in the example, while the drop weight pattern of the selected mask register 201 contains the following drop weight pattern: 110011001100. An "F" indicates the respective fluid actuator (associated with each of address 0 and address 1) in each of the three virtual primitives 1, 2, and 3 that is actuated in response to the combination of an actuation data bit and a drop weight pattern bit.

For actuation event 1, as shown in FIG. 6B, the mask register controller 502 causes a first shift operation 602-1 to occur in the selected mask register 201. In the example of FIG. 6B, the head of the mask register 201 is shifted into the tail of the mask register 201, and the drop weight pattern bits in the selected mask register 201 are shifted by two bit positions in the example shown. Shifting by two bit positions means that each bit in the mask register 201 is shifted along the shift direction by two positions in the mask register 201. In the example of FIG. 6B, the shift operation 602-1 in response to actuation event 1 causes addresses 2 and 3 to be selected in each virtual primitive. An "F" in FIG. 6B indicates each fluid actuator (associated with address 2 or 3) in each virtual primitive that is actuated.

If a primitive size were larger than four, then further shift operations in response to further successive actuation events can cause further shifting of the drop weight pattern bits by respective two-bit positions.

More generally, the mask register controller 502 is to shift the drop weight pattern in the selected mask register 201 in response to each actuation event of a set of actuation events, where the shifting is to cause enabling of a different set of fluid actuators for each successive actuation event. The shifting of the drop weight pattern in the selected mask register 201 can include a circular shift (as shown in FIGS. 6A-6B), or another type of shift, such as a bi-directional shift, first-in-first-out (FIFO) shift, or any other type of movement of bits in the mask register.

Figure 7:
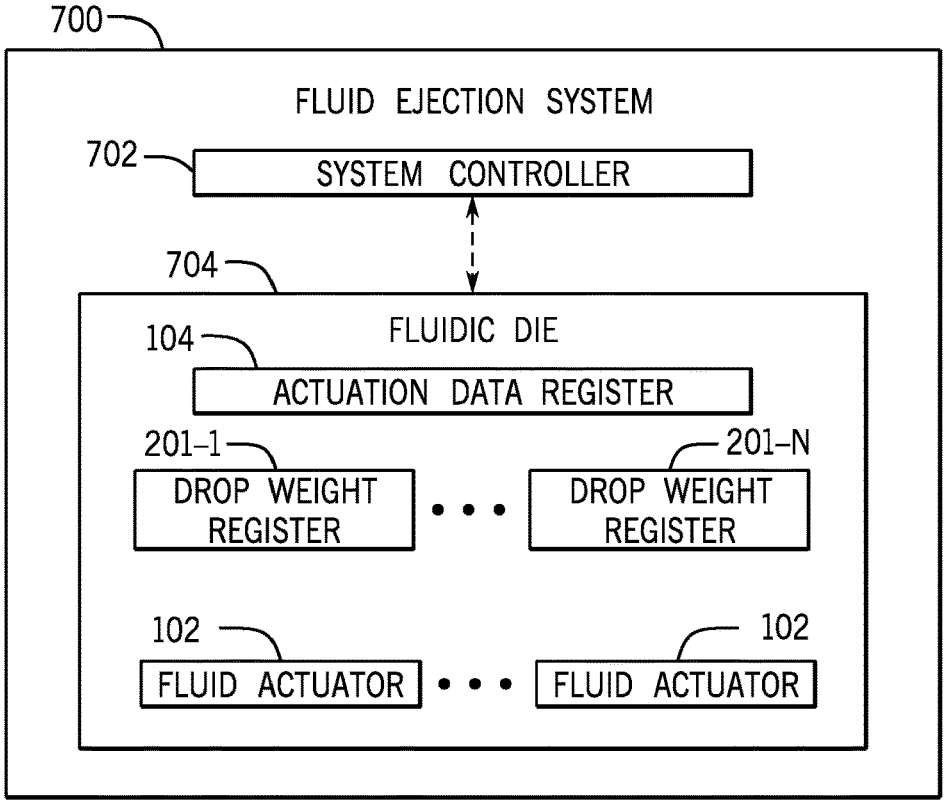
FIG. 7 is a block diagram of a fluid ejection system according to further examples.

FIG. 7 is a block diagram of an example fluid ejection system 700, which can be a printing system or any other system in which fluid displacement can be controlled. The fluid ejection system 700 includes a system controller 702. In a printing system, the system controller 702 is a printer controller.

The fluid ejection system 700 further includes a fluidic die 704, which includes a plurality of fluid actuators 102, an actuation data register 104 to store actuation data, and a plurality of drop weight registers 201-1 to 201-N to store respective different drop weight patterns.

The system controller 702 provides different information to the fluidic die 704 to cause selection of different drop weight registers to perform dynamic mode switching among different drop weights.

The system controller 702 is to cause the fluidic die 704 to select different drop weight registers to cause dynamic configuration of drop weights during a fluid displacement operation. For example, the system controller 702 can determine a first characteristic of a fluid pattern (e.g., fluid pattern for printing graphics) to be provided to a first portion of a target (e.g., a paper medium during a 2D printing operation). Responsive to the first characteristic, the system controller 702 causes the fluidic die 704 to select a first drop weight register storing the first drop weight pattern when ejecting fluid to the first portion of the target.

The system controller 702 can determine a second characteristic of a fluid pattern (e.g., fluid pattern to fill a large block of the same color) to be provided to a second portion of the target, and responsive to the second characteristic, cause the fluidic die 704 to select a second droop weight register storing the second drop weight pattern when ejecting fluid to the second portion of the target.

Figure 8:
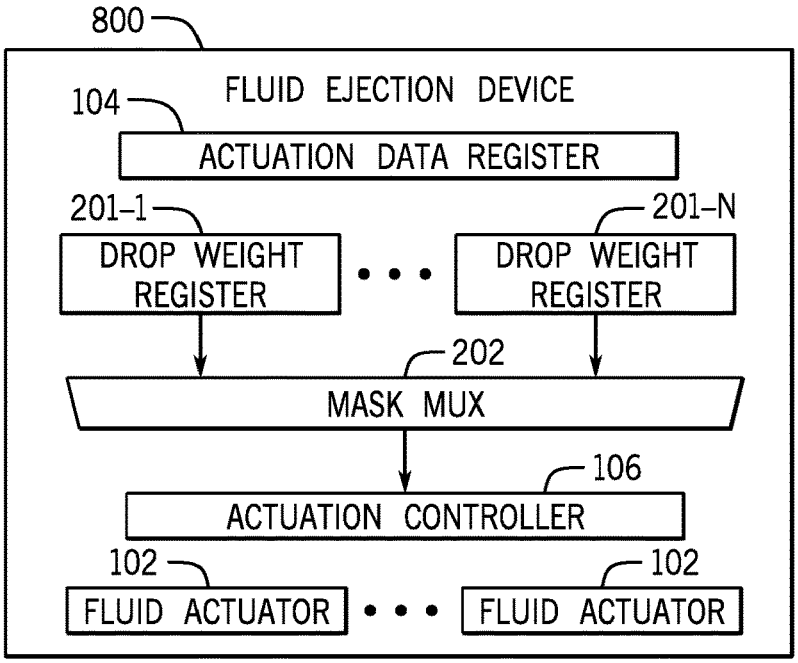
FIG. 8 is a block diagram of a fluid ejection device according to alternative examples.

FIG. 8 is a block diagram of a fluid ejection device 800 that includes a plurality of fluid actuators 102, an actuation data register 104 to store actuation data, a plurality of drop weight registers 201-1 to 201-N to store respective different drop weight patterns, and a mask multiplexer 202 to select different drop weight registers for respective different sets of actuation events.

As noted above, in some examples, certain logic (such as the various controllers) can be implemented as either a hardware processing circuit or as a combination of a hardware processing circuit and machine-readable instructions (software or firmware) executable on the hardware processing circuit.

In examples where machine-readable instructions are employed, the machine-readable instructions can be stored in a non-transitory machine-readable or computer-readable storage medium.

The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluidic die comprising:

a plurality of fluid actuators to cause ejection of fluid towards a target, wherein the plurality of fluid actuators are partitioned into multiple primitives;

an actuation data register to store actuation data that indicates each fluid actuator of the plurality of fluid actuators to actuate; and a controller to use different drop weight patterns and the actuation data in the actuation data register to dispense fluid of different drop weights using the plurality of fluid actuators, each drop weight pattern of the different drop weight patterns indicating a respective set of fluid actuators of the plurality of fluid actuators enabled for actuation, and a first drop weight pattern of the different drop weight patterns corresponding to a first drop weight, and a second drop weight pattern of the different drop weight patterns corresponding to a second drop weight different from the first drop weight, wherein each primitive of the multiple primitives has a size corresponding to a number of fluid actuators, the first drop weight pattern corresponds to a primitive of a first primitive size, and the second drop weight pattern corresponds to a primitive of a second primitive size different from the first primitive size, wherein:

responsive to the controller selecting the first drop weight pattern, each primitive of the multiple primitives has the first primitive size, and responsive to the controller selecting the second drop weight pattern, each primitive of the multiple primitives has the second primitive size.

2. The fluidic die of claim 1, further comprising a plurality of mask registers to store respective drop weight patterns of the different drop weight patterns.

3. The fluidic die of claim 2, further comprising:

a multiplexer to select a mask register of the plurality of mask registers, wherein the controller is to control actuation of a set of fluid actuators of the plurality of fluid actuators based on the actuation data in the actuation data register and the drop weight pattern in the selected mask register.

4. The fluidic die of claim 3, wherein the multiplexer is to select different mask registers of the plurality of mask registers in response to different sets of actuation events.

5. The fluidic die of claim 3, wherein the multiplexer is to select different mask registers of the plurality of mask registers during a fluid displacement operation.

6. The fluidic die of claim 1, wherein the first drop weight pattern enables, for each primitive of the multiple primitives, a first number of fluid actuators, and the second drop weight pattern enables, for each primitive of the multiple primitives, a second number of fluid actuators.

7. The fluidic die of claim 1, wherein each drop weight pattern of the different drop weight patterns includes a collection of bits, wherein a bit of the collection of bits set to a first value enables a respective fluid actuator, and the bit set to a second value disables the respective fluid actuator.

8. The fluidic die of claim 7, wherein each drop weight pattern includes multiple occurrences of a sequence of bits set to respective values.

9. A fluid ejection system comprising;

a system controller; and a fluidic die comprising:

a controller;

a plurality of fluid actuators to cause ejection of fluid towards a target, wherein the plurality of fluid actuators are partitioned into multiple primitives;

an actuation data register to store actuation data that indicates each fluid actuator of the plurality of fluid actuators to actuate; and a plurality of registers to store respective different drop weight patterns, each drop weight pattern of the different drop weight patterns indicating a respective set of fluid actuators of the plurality of fluid actuators enabled for actuation, and a first drop weight pattern of the different drop weight patterns corresponding to a first drop weight, and a second drop weight pattern of the different drop weight patterns corresponding to a second drop weight different from the first drop weight, wherein each primitive of the multiple primitives has a size corresponding to a number of fluid actuators, the first drop weight pattern corresponds to a primitive of a first primitive size, and the second drop weight pattern corresponds to a primitive of a second primitive size different from the first primitive size, wherein:

responsive to the controller of the fluidic die selecting the first drop weight pattern, each primitive of the multiple primitives has the first primitive size, and responsive to the controller of the fluidic die selecting the second drop weight pattern, each primitive of the multiple primitives has the second primitive size.

10. The fluid ejection system of claim 9, wherein the system controller is to cause the fluidic die to select different registers of the plurality of registers to cause dynamic configuration of drop weights during a fluid displacement operation.

11. The fluid ejection system of claim 10, wherein the system controller is to:

determine a first characteristic of a fluid pattern to be provided to a first portion of the target;

responsive to the first characteristic, cause the fluidic die to select a first register storing the first drop weight pattern when ejecting fluid to the first portion of the target;

determine a second characteristic of a fluid pattern to be provided to a second portion of the target;

responsive to the second characteristic, cause the fluidic die to select a second register storing the second drop weight pattern when ejecting fluid to the second portion of the target.

12. The fluid ejection system of claim 9, wherein the fluidic die further comprises:

a multiplexer to select a register of the plurality of registers; and an actuation controller to control actuation of a set of fluid actuators of the plurality of fluid actuators based on the actuation data in the actuation data register and the drop weight pattern in the selected register.

13. A fluid ejection device comprising:

a plurality of fluid actuators to cause ejection of fluid towards a target, wherein the plurality of fluid actuators are partitioned into multiple primitives;

an actuation data register to store actuation data that indicates each fluid actuator of the plurality of fluid actuators to actuate;

a plurality of mask registers to store respective different drop weight patterns, each drop weight pattern of the different drop weight patterns indicating a respective set of fluid actuators of the plurality of fluid actuators enabled for actuation, and a first drop weight pattern of the different drop weight patterns corresponding to a first drop weight, and a second drop weight pattern of the different drop weight patterns corresponding to a second drop weight different from the first drop weight, wherein each primitive of the multiple primitives has a size corresponding to a number of fluid actuators, the first drop weight pattern corresponds to a primitive of a first primitive size, and the second drop weight pattern corresponds to a primitive of a second primitive size different from the first primitive size;

a multiplexer to select a mask register of the plurality of mask registers; and an actuation controller to control actuation of a set of fluid actuators of the plurality of fluid actuators based on the actuation data in the actuation data register and the drop weight pattern in the selected mask register, wherein:

responsive to the multiplexer selecting the first drop weight pattern, each primitive of the multiple primitives has the first primitive size, and responsive to the multiplexer selecting the second drop weight pattern, each primitive of the multiple primitives has the second primitive size.

14. The fluid ejection device of claim 13, further comprising:

a mask register controller to shift the drop weight pattern in a selected mask register selected by the multiplexer, the shifting in response to each actuation event of a set of actuation events.

* * * * *